US010066477B2

(12) United States Patent
Borowitsh et al.

(10) Patent No.: US 10,066,477 B2
(45) Date of Patent: Sep. 4, 2018

(54) TUNNEL DETECTION METHOD AND SYSTEM

(71) Applicants: Zvi Borowitsh, Herzliya (IL); David David, Herzliya (IL); Eli Raz, Natzrat Illit (IL)

(72) Inventors: Zvi Borowitsh, Herzliya (IL); David David, Herzliya (IL); Eli Raz, Natzrat Illit (IL)

( * ) Notice: Subject to any disclaimer, the term of this patent is extended or adjusted under 35 U.S.C. 154(b) by 0 days.

(21) Appl. No.: 15/300,758

(22) PCT Filed: Mar. 30, 2015

(86) PCT No.: PCT/IL2015/050337

§ 371 (c)(1),
(2) Date: Sep. 29, 2016

(87) PCT Pub. No.: WO2015/151089

PCT Pub. Date: Oct. 8, 2015

(65) Prior Publication Data

US 2017/0016314 A1 Jan. 19, 2017

(30) Foreign Application Priority Data

Mar. 30, 2014 (IL) ..... 231803

(51) Int. Cl.

| | |
|---|---|
| ***E21B 47/04*** | (2012.01) |
| ***F41H 11/00*** | (2006.01) |
| ***E02D 17/06*** | (2006.01) |

(52) U.S. Cl.

CPC ..... *E21B 47/042* (2013.01); *E02D 17/06* (2013.01); *F41H 11/00* (2013.01); *E02B 2201/00* (2013.01)

(58) Field of Classification Search

CPC ..... E02D 17/06; E21B 47/042

See application file for complete search history.

(56) References Cited

U.S. PATENT DOCUMENTS

| | | | | |
|---|---|---|---|---|
| 3,946,605 | A | 3/1976 | Yamazaki et al. | |
| 4,453,366 | A | 6/1984 | Piccagli | |
| 4,725,164 | A | 2/1988 | Sagefors | |
| 4,770,708 | A * | 9/1988 | Atkins | C04B 28/04 106/708 |
| 2012/0018634 | A1 | 1/2012 | Vincent et al. | |
| 2014/0034875 | A1 | 2/2014 | Nakarai et al. | |

FOREIGN PATENT DOCUMENTS

| | | |
|---|---|---|
| CA | 2514982 C | 10/2012 |
| GB | 2472079 A1 | 2/2011 |

OTHER PUBLICATIONS

Vesecky et al., "Tunnel Detection", SRI International, 1980.
International Search Report for PCT Application No. PCT/IL2015/050337 dated Oct. 23, 2015 in 7 pages.
Written Opinion for PCT Application No. PCT/IL2015/050337 dated Oct. 23, 2015 in 7 pages.

* cited by examiner

*Primary Examiner* — Curtis Odom

(74) *Attorney, Agent, or Firm* — Knobbe, Martens, Olson & Bear, LLP

(57) ABSTRACT

A system and method are for detecting and identifying underground tunnels by using: (i) bentonite-slurry for filling at least one essentially-vertical moat along a desired borderline, (ii) at least one detection device associated with the moat(s); and (iii) at least one control system connected to all detection devices.

16 Claims, 7 Drawing Sheets

David DAVID Engineering TEL AVIV — October 31th, 2014

Acktiv-Bentonite IBBCO BDF APIS&B

Laboratory test summary

| 1 | Scope of work & Test procedure |
|---|---|
| | Comparative test program between fresh bentonite slurry properties and site sample: Viscosity, yield value – filter cake & water loss assessment. |

| 2 | Mix design | Weight | Spg | | | | Volume |
|---|---|---|---|---|---|---|---|
| 2.1 | Acktiv-Bentonite IBBCO BDF APIS&B | 40 | 2.5 | | | | 16 |
| | Water (deionized) | 984 | | | | | 984 |
| | | 1024 | 1.024 | | | | 1000 |
| 2.2 | Acktiv-Bentonite IBBCO BDF APIS&B | 80 | 2.5 | | | | 32 |
| | Water (deionized) | 968 | | | | | 968 |
| | | 1048 | 1.048 | | | | 1000 |
| 2.3 | Acktiv-Bentonite IBBCO BDF APIS&B | 80 | 2.5 | | | | 32 |
| | Water (Tap water) | 968 | | | | | 968 |
| | | 1048 | 1.048 | | | | 1000 |
| 2.4 | Acktiv-Bentonite IBBCO BDF APIS&B | 80 | 2.5 | | | | 32 |
| | Water (site supply) | 968 | | | | | 968 |
| | Site sample (theoretical) | 1048 | 1.048 | | | | 1000 |
| | Site sample (effective) | | 1.086 | | | | 1000 |
| | Silt & Sand content | 66 | 1.086 | | | | 1000 |

| 3 | Test results | | | | | | | | | |
|---|---|---|---|---|---|---|---|---|---|---|
| | Sample | Time (min) | RPM 300 | RPM 600 | Vp (mPass) | Yield (lb/in$^2$) | Yp/Vp | Filter-cake | W loss(7'30) | W loss ('30) |
| | 2.1 | 0 | 2 | 4 | 2 | 0 | 0.00 | | | |
| | 40 kg/m$^3$ | 30 | 5 | 9 | 4 | 1 | 0.25 | | | |
| | | 60 | 8 | 12 | 4 | 4 | 1.00 | | | |
| | | 1440 | 16 | 22 | 6 | 10 | 1.67 | 1.5 | 12.00 | 25 |
| | | | | | | | | | | |
| | 2.2 | 0 | 13 | 21 | 8 | 5 | 0.63 | | | |
| | 80 kg/m$^3$ | 15 | 17 | 25 | 8 | 9 | 1.13 | | | |
| | | 1440 | 72 | 90 | 18 | 54 | 3.00 | | | |
| | | | 69 | 85 | 16 | 53 | 3.31 | | | |
| | | | 70 | 87 | 17 | 53 | 3.12 | | | |
| | | | | | | | | | | |
| | 2.3 | 0 | 12 | 20 | 8 | 4 | 0.50 | | | |
| | 80 kg/m$^3$ | 0 | 0 | 0 | 0 | 0 | 0.00 | | | |
| | | 2400 | | | | | | 3.5 | | 17 |
| | | | | | | | | | | |
| | 2.4 | 19/08/2014 | 20 | 30 | 10 | 10 | 1.00 | | | |
| | Site sample | 26/10/2014 | 22 | 34 | 12 | 10 | 0.83 | | | |
| | | 27/10/2014 | | | | | | 2.5 | | 17.5 |
| | 80 kg/m$^3$ | 28/10/2014 | | | | | | 2.5 | | 18 |
| | | | | | | | | | | |
| | | | | | | | | | | |
| | Tech data | | | >30 | | | <6 | | | 16 |

Fig. 7A

| | | | | | | | | |
|---|---|---|---|---|---|---|---|---|
| | Professional test | Lab sample | 600 | Water loss | 12,00 | % | 2,0 | |
| | | Lab sample | 600 | Water loss | 25,00 | % | 4,17 | |
| | | Site sample | 600 | Water loss | 18,00 | % | 3,00 | |

| | | | | | | | | | | | | |
|---|---|---|---|---|---|---|---|---|---|---|---|---|
| 4 | Quality control – Onsite sample | | | | | | | | | | | |
| | Slurry Component properties | | | | | | | | | | **Onsite panel data** | |
| | Slurry Spg (excavation) | 1,086 | g/cm$^3$ | | | | | Construction Data August 19th 2014 | | | length(m) | 3,40 |
| | Bentonite content (dry) | 80,00 | kg/cm$^3$ | | | | | | | | width(m) | 0,80 |
| | Bentonite (Spg) | 2,65 | g/cm$^3$ | | | | | | | | depth(m) | 20,00 |
| | Soil (Spg) | 2,65 | g/cm$^3$ | | | | | | | | **Panel section** | |
| | Soil W % (*) | 10,00 | % | | | | | | | | (m$^2$) | 2,72 |
| | | | | | | | | | | | **Panel volume** | |
| | Fresh slurry (Spg) | | | | | | | | | | (m$^3$) | 54,4 |
| | Water content % | 969,81 | L | | | | | | | | **Panel surface** | |
| | Fresh slurry (Spg) | 1,050 | g/cm$^3$ | | | | | | | | (m$^2$) | 170,72 |
| | | | | | | | | | | | | |
| | Equation system: | 1049,81132 | | X+ | 1,1 | Y= | 1086 | | | | **Gradient pressure (kPa)** | |
| | | 1000 | | X+ | 0,48 | Y= | 1000 | | | | TN=0,00 | 0,00 |
| | | | | | | | | | | | (-20m) | 217,20 |
| | Delta | -598,863653 | | | | | | | | | Average F | 108,60 |
| | Slurry proportion X= | 0,97115375 | | | | | | | | | | |
| | Soil proportion Y= | 60,4289125 | | | | | | 19/08/2014 | | | Volume loss (versus time) | |
| | | | | | | | | Time | | Delta h (m) | Volume | Volume loss % |
| | | | | | | | | min | √t | | | |
| | Onsite sample content | | | | | | | 4320,00 | 65,73 | 0,55 | 1,496 | 2,75 |
| | Water | 948,00 | L | | | | | 12960,00 | 113,84 | 1,25 | 3,4 | 6,25 |
| | Bentonite | 78,00 | Kg | | | | | 15840,00 | 125,86 | 1,80 | 4,896 | 9,00 |
| | Soil (silt & sand) | 60,00 | Kg | | | | | 33120,00 | 181,99 | 3,15 | 8,568 | 15,75 |
| | | | | | | | | 525600,0 | 724,98 | ? | ? | ? |

| | | | | | |
|---|---|---|---|---|---|
| | Laboratory tests – Pressiofiltration API Standard | | | | |
| | 26/10/2014 | | | Volume loss % (versus time) | |
| | Time (min) | Time (√t) | | Volume | Volume loss % |
| | 7,50 | 2,74 | 3,50 | 600 | 0,58 |
| | 30,00 | 5,48 | 17,00 | 600 | 2,83 |
| | | | | | |

Fig. 7B

TUNNEL DETECTION METHOD AND SYSTEM

This application is the U.S. National Phase under 35. U.S.C. § 371 of International Application PCT/IL2015/050337, filed Mar. 30, 2015, which claims priority to Israeli Patent Application No. 231803, filed on Mar. 30, 2014. The disclosures of the above-described applications are hereby incorporated by reference in their entirety.

FIELD OF THE INVENTION

The present invention generally relates to the field of underground tunnel detection. The present invention further relates to a system and method for detecting and identifying underground tunnels by using bentonite-slurry.

BACKGROUND OF THE INVENTION

In general, there is an ever-growing need for new and improved ways to reliably detect underground tunnels of various sorts. Specifically, detecting underground tunnels is very important for preventing smugglings, prison brakes, terroristic attacks, and any other illegal or subversive activity which uses hidden tunnels. In addition, ground or air invasions are visible and easily detectable, underground invasions or attacks are undetectable and unpredictable, further stressing the need to detect underground tunnels at conflict areas.

Today, tunnel digging is relatively easy and fast, and diggers can create very long tunnels at great depths, such as 20 meters deep. In addition, thanks to modern technology, diggers can control their underground location with great accuracy enabling them to reach their exact destination even after a long dig. This leads to the creation of extremely long tunnels beginning deep in an opponent's area, such as an enemy city near a border, which is not monitored or controlled by the neighboring opponent. Moreover, such tunnels can begin from within a building, thereby preventing satellite or aerial identification of the tunnel opening.

Accordingly, many techniques have been developed to detect such underground tunnels and to prevent their digging. Currently, except visually detecting at the ground site, underground tunnel detections are attempted by way of a variety of single sensor and multi-sensor approaches utilizing a broad spectrum of technologies. Some of the technologies include seismic-acoustic methods utilizing compressional seismic (P) waves, electromagnetic and resistivity, ground penetrating radar, and magnetic methods. Some of the more recently developed approaches utilize microgravity and subsurface interface radar (see, e.g., CA 2514982, US 2012/0186342 and Vesecky et al., "Tunnel Detection", SRI International, 1980).

However, all of the current technologies being utilized toady to detect underground tunnels include various inherent problems such as excessive clutter, excessive signal loss due to varying soil/rock mediums, and excessive false-positive and false-negative readouts due to the in-homogeneities present underground. These inherent problems complicate and prevent reliable tunnel detection.

In addition, the outputs of the above various techniques is usually a measured signal or a representative image of variations in the scanned/sensed soil. However, these outputs first have to be interpreted by highly trained analysts before any determinations are formed, and by nature these interpretations are subjective and might be unreliable. Moreover, the processing rate tends to be very slow with an extremely high occurrence of false-positive and false-negative results.

Other techniques aim at blocking underground passageways, e.g. by placing a thick un-tampered steel or concrete wall along a bordering line.

Accordingly, there exists a long felt need for an improved technology and method for detecting and identifying underground tunnels that alleviates the known inherent problems present within the technologies and methods used today for detecting tunnels in the various industries. Accordingly, the presently invented system and method for detecting and identifying newly dug underground tunnels overcomes all the disadvantages of the prior art methods, and are intended to help and satisfy this important long felt need.

All publications mentioned throughout this application are fully incorporated herein by reference, including all references cited therein.

SUMMARY OF THE INVENTION

The present invention provides a system for detecting and/or identifying underground tunnels, comprising: (a) at least one bentonite-slurry filled essentially-vertical moat; (b) at least one detection device associated with each of said at least one moat; and (c) at least one control system connected to all of said at least one detection devices, wherein when an underground tunnel is expanded to traverse any of said at least one moat, said bentonite-slurry drains into said underground tunnel and the detection device associated with said moat alerts that the bentonite-slurry has drained thus signaling the existence of an underground tunnel in the location of the moat.

The present invention also provides a system for detecting underground tunnels, comprising: (a) a plurality of bentonite-slurry filled essentially-vertical moats which are dug along a bordering line at two essentially-parallel dashed lines with about 1 meter spacing between the lines, wherein the openings (the un-dug sections) in the first line are placed in front of the moats of the second line, thereby creating a zipper-like line; (b) a detection device associated with each of said moats designed to measure the level and/or volume of the bentonite-slurry in the moat, which immediately drops when a newly dug underground tunnel reaches the bentonite-slurry filled moat; and (c) at least one control system connected to all of said detection devices, and sends out an alert when the level and/or volume of the bentonite-slurry drops, thereby indicating the presence of a newly dug underground tunnel.

The present invention further provides a method for detecting and/or identifying underground passageways or tunnels, comprising: (a) digging and filling with bentonite-slurry at least one essentially-vertical moat along a bordering line; (b) placing at least one detection device at each of said moats, designed to detect any change in the level and/or volume and/or other properties of the bentonite-slurry; and (c) connecting said at least one detection device to at least one control system designed to monitor and alert when detecting such changes, wherein the detection of any change in the bentonite-slurry in the moat indicates the presence of a newly dug underground passageway.

The present invention also provides a method for detecting and/or identifying underground passageways or tunnels, comprising: (a) digging and filling with bentonite-slurry a plurality of essentially-vertical moats along a bordering line at two essentially-parallel dashed lines with about 1 meter spacing between the lines, wherein the openings (the un-dug sections) in the first line are placed in front of the moats of the second line, thereby creating a zipper-like line; (b) placing a detection device at each of said moats, designed to detect any change in the level and/or volume of the bentonite-slurry, which immediately drops when a newly dug underground tunnel reaches the bentonite-slurry filled moat; and (c) connecting all of said detection devices to a control system designed to monitor and alert when detecting such changes, wherein the detection of such changes in the bentonite-slurry in the moat indicates the presence of a newly dug underground tunnel.

In addition, the invention provides use of bentonite for detecting and/or identifying man-made underground tunnels.

BRIEF DESCRIPTION OF THE DRAWINGS

The invention will now be described in connection with certain embodiments with reference to the following, non-limiting, illustrative figures so that it may be more fully understood. With specific reference to the figures in detail, it is stressed that the particulars shown are by way of example and for purposes of illustrative discussion of the embodiments of the present invention only. The description, taken with the drawings making apparent to those skilled in the art how different forms of the invention may be embodied in practice. In the drawings:

FIG. 6 illustrates a single bentonite-filled moat.

FIGS. 7A-B shows results of laboratory tests on various bentonite slurries.

DETAILED DESCRIPTION OF THE INVENTION

Figure 1:
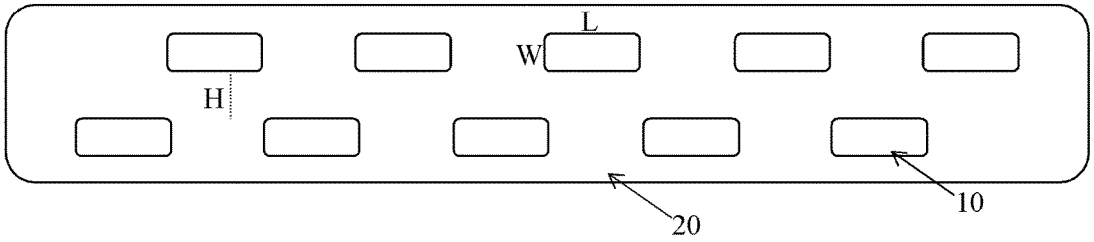
FIG. 1 illustrates two dashed lines of moats (10) along a bordering line forming a zipper-like line.

The primary invention is a system for detecting and/or identifying underground tunnels. Specifically, the systems and methods of the invention for detecting and/or identifying underground tunnels as illustrated in the figures exemplify only a few possibilities of how to utilize bentonite-slurry for detecting and/or identifying underground tunnels, and should not be considered as limiting in any way.

"Bentonite" is an absorbent phyllosilicate, essentially impure clay consisting mostly of montmorillonite. There are different types of bentonite, each named after the respective dominant element, such as potassium (K), sodium (Na), calcium (Ca), and aluminum (Al). Bentonite usually forms from weathering of volcanic ash, most often in the presence of water. Bentonite is widely used in the industry, mainly for digging foundations and basement supporting walls.

The terms "bentonite" or "bentonite-slurry" as used in the invention, includes all types of bentonite, including potassium-bentonite, sodium-bentonite, calcium-bentonite, and aluminum-bentonite. It also includes any mixture of bentonite-cement, as well as any slurry mixture comprising bentonite. Non-limiting examples of bentonite-slurry mixtures include bentonite with fluid-loss control agents, cement-benonite mixture, cement-benonite mixtures with fluid-loss control agents, and bentonite-slurry mixtures with various cement glues. One example of such a fluid-loss control agent is Flodrill™.

It should be noted that the term "tunnel" includes all types of underground digs, such as underground passageways, subsurface digs, or any underground concealed passage fit to transport people and/or objects. Typical objects transported in such tunnel include all types of weapons and military equipment and smuggled goods.

Accordingly, one aspect of the invention is a system for detecting underground tunnels, comprising: (i) at least one bentonite-slurry filled essentially-vertical moat; (ii) at least one detection device associated with each of said at least one moat; and (iii) at least one control system connected to all of said at least one detection devices, wherein when an underground tunnel is expanded to traverse any of said at least one moats, said bentonite-slurry drains into said underground tunnel and the detection device associated with said moat alerts that the bentonite-slurry has drained thus signaling the existence of an underground tunnel in the location of the moat.

According to a specific embodiment, said essentially-vertical moats are dug along a bordering line at a single line with a maximum of 1 meter interval between each moat.

The term "essentially-vertical" as used herein denotes that the longitudinal axis of the moat is positioned within about 30° of vertical, within about 15°, or within about 5° of vertical.

The terms "border" or "bordering line" may be any border or boundary separating two countries, or even any imaginary or abstract line defining a perimeter surrounding a determined area such as a city, a base, a military base, a prison, a factory, any restricted area, etc.

Figure 2:
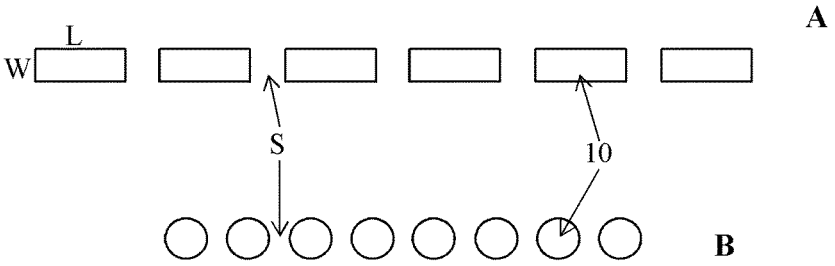
FIG. 2 illustrates a single dashed line of moats (10) along a bordering line.
Figure 3A:
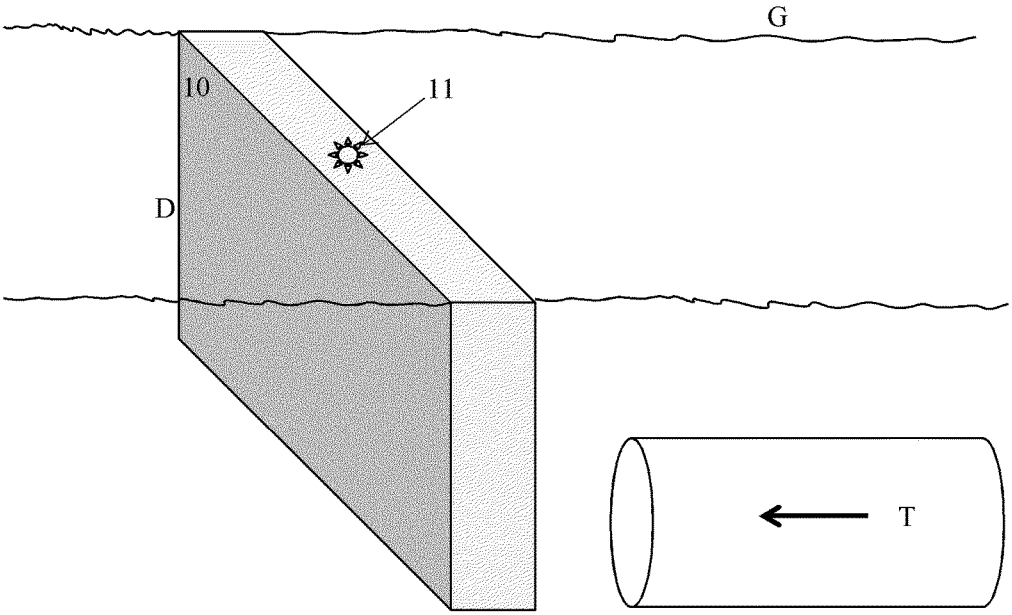
FIG. 3A illustrates the tunnel detection system of the invention when a tunnel (T) is about to reach the bentonite-slurry filled moat (10)
Figure 3B:
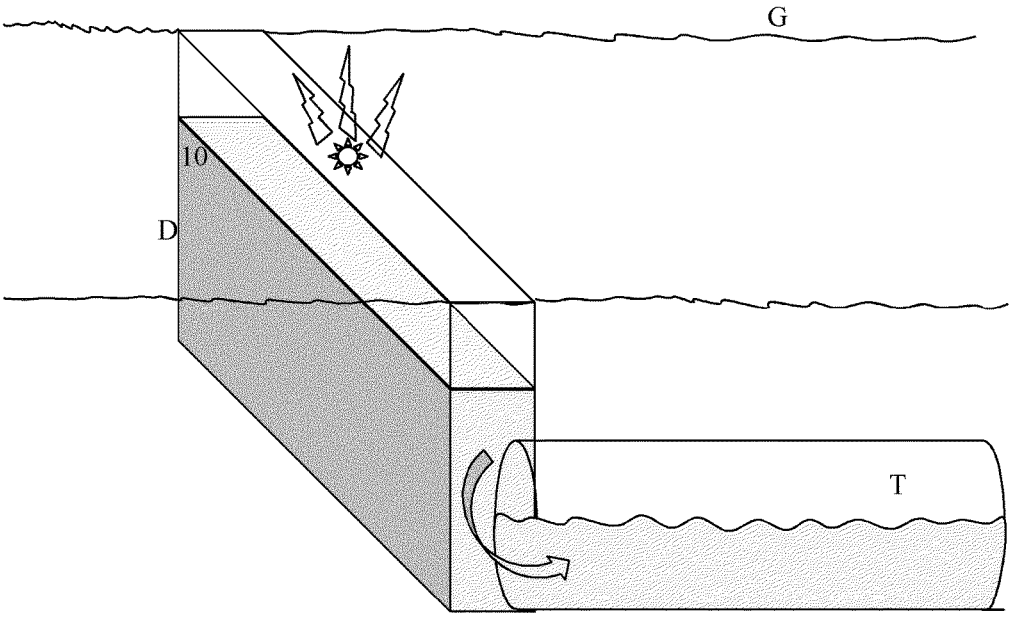
FIG. 3B illustrates the system when a tunnel reaches the moat (10) and the bentonite-slurry exits the moat and fills the tunnel, which activates the sensor (11).

Notably, the moats (10) used according to the present invention may be in any shape, such as round, oval, square, rectangular, etc. As illustrated in FIG. 2, the moats (10) can be aligned in a single line along a border with a space (S) of about 1 meter between each moat (10).

The length (L) of each moat is not limited and can vary, but in order to prevent possible miss an underground tunnel and in order to enable to determining precisely where the underground tunnel is, the moat should be between about 1 meter and about 6 meter long, about 2 meter, about 3 meter or about 4 meter long.

The width (W) of each moat is also not limited and can vary, but solely for minimizing costs, it should be at least about 0.3 meter and no more than 1 meter wide. The cross section or shape of the moat is not limited and is mainly determined by a structural strength aspect, which is determined according to several aspects, including the type of soil, depth, width and length of the moat, and the bentonite-slurry properties which keeps the entire structure from collapsing.

The depth (D) of each moat can vary dependent on the type of bordering line, as well as according to the ground type and presence of groundwater. It should be stressed that the system of the invention is useful in any type of soil, including sand, gravel, rock, etc. In addition, although in many cases the moat will be to the depth of underwater due to the unlikelihood of mining tunnels beneath such underwater, the bentonite-slurry filled moats according to the invention can be created even below the depth of groundwater. In most cases, a depth of about 20 to about 30 meter is sufficient to detect illegal tunnels which usually are not dug to depths below groundwater.

As illustrated in FIG. 1, said essentially-vertical moats (10) in the system of the invention are dug along a bordering line at two essentially-parallel dashed lines with about 1 meter spacing (H) between the lines, and wherein the openings (the un-dug sections in each line) in the first line are placed in front of the moats (10) of the second line, thereby creating a zipper-like line. FIG. 1 further illustrates the possibility of paving a road-like structure or continuous pavement (20) along and over the moats (10) thereby enabling easy approach for maintenance, further defining the bordering line, and enables covering the moats with covers or shields to prevent unintentional falls therein, and to enable safe crossover.

According to another embodiment, the detection device used in the system or method of the invention measures any desired parameter of the bentonite-slurry fill, including, but not limited to, level, volume, viscosity, content, conductivity, height, movement, position, etc., or any combination thereof.

In certain embodiment, the detection device may be any suitable means for detection, such as mechanical- or electrical-sensors, chemical-sensors, or any manual sensing device. In certain embodiments, the detection device may also be an actual person(s) which is responsible for checking the moats on a regular basis.

The detection devices or sensors used in the present system may be placed inside the bentonite-slurry in the moat at any height or depth. For instance, a sensor may be placed every 0.5, 1, 1.5, 2, 2.5, 3, 3.5, 4, 4.5 or 5 meters. Said sensors may be placed throughout the entire moat or only at its top, bottom or middle or any combination thereof.

In a specific embodiment, when the measured parameter is movement, the motion-sensor may identify vibrations of the bentonite-slurry or of the surrounding near the moat.

The term "essentially parallel" should be understood here to mean a direction which compared to a reference direction has a deviation that is less than 15°, less than 8°, or less than 3°.

In another embodiment, the control system in the tunnel detection system of the invention sends out an alert in response to any change in the measured parameter of a detection device indicating the presence of a newly dug tunnel in the area of the detection device. In a specific embodiment, the measured parameter is the level and/or the volume of the bentonite-slurry in the moat, which immediately drops when an expanding underground tunnel reaches the bentonite-slurry filled moat.

According to yet another embodiment of the invention, the moats have a guide at their opening. Said guide can be made of concrete, metal, plastic or any suitable material, and is designed to assist in the digging and filling of the moat. In one embodiment, said guides are formed together with the paving of a road-like structure or continuous pavement along the bordering line. Said guide may further serve as a base for a cover for the opening of the moat, wherein said cover is designed, e.g., to prevent unintentional falls therein, and/or to enable safe crossover. In one embodiment, said covers wherein said covers comprise an access point enabling easy viewing and/or testing the bentonite-slurry inside the moat. The upper surface of the guide may be in line with ground surface or extend therefrom to any height.

According to some embodiments, the invention provides a system for detecting underground tunnels, comprising: (a) a plurality of bentonite-slurry filled essentially-vertical moats which are dug along a bordering line at two essentially-parallel dashed lines with about 1 meter spacing between the lines, wherein the openings (the un-dug sections) in the first line are placed in front of the moats of the second line, thereby creating a zipper-like line; (b) a detection device associated with each of said moats designed to measure the level and/or volume of the bentonite-slurry in the moat, which immediately drops when a newly dug underground tunnel reaches the bentonite-slurry filled moat; and (c) at least one control system connected to all of said detection devices, and sends out an alert when the level and/or volume of the bentonite-slurry in the moat drops, thereby indicating the presence of a newly dug underground tunnel.

In another embodiment, the system of the present invention is suitable for preventing passage through underground tunnels, since when an underground tunnel is expanded to traverse any of said at least one moat, said bentonite-slurry drains into said underground tunnel thereby preventing passage through the tunnel.

In certain embodiments, the present invention provides a method for identifying underground passageways or tunnels, said method comprises digging and filling with bentonite-slurry at least one essentially-vertical moat, wherein the detection or identification that the bentonite-slurry drains into said at least one moat during the dig is an indication or sign of the presence of an underground passageway or tunnel at that location. This identification can occur either during a specific underground tunnel search & identify activity, or during the creation and placement of the tunnel detection system of the invention along a borderline, which will indicate that at that point an underground tunnel is already present.

The present invention further relates to a method for detecting and/or identifying underground passageways or tunnels, said method comprises: (a) digging and filling with bentonite-slurry at least one essentially-vertical moat along a bordering line; (b) placing at least one detection device at each of said moats, designed to detect any change in the level and/or volume and/or other properties of the bentonite-slurry; and (c) connecting said at least one detection device to at least one control system designed to monitor and alert when detecting such changes, wherein the detection of any change in the bentonite-slurry in the moat indicates the presence of a newly dug underground passageway.

The present invention also provides a method for preventing passage through underground passageways or tunnels, comprising: digging and filling with bentonite-slurry at least one essentially-vertical moat along a bordering line, wherein when an underground tunnel is expanded to traverse any of said at least one moat, said bentonite-slurry drains into said underground tunnel thus preventing passage through the tunnel; and optionally placing at least one detection device at each of said moats, designed to detect any change in the level and/or volume and/or other properties of the bentonite-slurry; and connecting said at least one detection device to at least one control system designed to monitor and alert when detecting such changes, wherein the detection of any change in the bentonite-slurry in the moat indicates the presence of a newly dug underground passageway.

In one embodiment, the method of the invention further comprises, prior to digging said moats, paving a continuous pavement or road-like structure along the bordering line, while forming a guide for each moat. Each of said moats may be closed after filling by placing a cover on each guide.

According to one embodiment of the invention, the essentially-vertical bentonite-slurry filled moat runs along essentially the entire bordering line of interest.

In an embodiment, the digging of the moats is done to any desired depth. In a specific embodiment, the moats are dug to the depth of groundwater.

In some embodiments, the moats of the invention have a rectangle shape, and are dug at a single line with a maximum of 1 meter interval between each moat. In yet another embodiment, the moats of the invention are dug along the bordering line at two essentially-parallel dashed lines with about 1 meter spacing between the lines, and wherein the openings in the first line are placed in front of the moats of the second line, thereby creating a zipper-like line.

In some embodiments, the moats of the invention have a rectangle-like shape of about 1 to about 6 meter long, and at least about 0.3 to about 1 meter wide. In yet another specific embodiment of the invention, the moats of the invention have a rectangle-like shape of about 3 meter long, and about 0.4 meter wide. In another embodiment of the invention a road-like structure is paved along and on top of the moats, thereby enabling easy movement along the moats, e.g. for maintenance.

Bentonite is known to maintain its properties even after use. Accordingly, it is common practice in the building industry, which uses bentonite, to recycle used bentonite. Such recycling is relatively easy and simple. Accordingly, an embodiment of the invention refers to the possibility of removing the bentonite-slurry from the moats when it is no longer needed, or if a need arises to move the moats, and re-using it elsewhere.

In some embodiments, the present invention provides a method for detecting and/or identifying underground passageways or tunnels, comprising: (a) digging and filling with bentonite-slurry a plurality of essentially-vertical moats along a bordering line at two essentially-parallel dashed lines with about 1 meter spacing between the lines, wherein the openings (the un-dug sections) in the first line are placed in front of the moats of the second line, thereby creating a zipper-like line; (b) placing a detection device at each of said moats, designed to detect any change in the level and/or volume of the bentonite-slurry, which immediately drops when a newly dug underground tunnel reaches the bentonite-slurry filled moat; and (c) connecting all of said detection devices to a control system designed to monitor and alert when detecting such changes, wherein the detection of such changes in the bentonite-slurry in the moat indicates the presence of a newly dug underground tunnel.

In an embodiment, the method of the invention further comprises filling the detected tunnel with bentonite-slurry for preventing passage through the tunnel.

According to an embodiment, the present invention provides a method for preventing passage through underground passageways or tunnels, comprising: (a) detecting an underground passageway or tunnel; and (b) filling said passageway or tunnel with bentonite-slurry.

The present invention further relates to the use of bentonite, or any bentonite-containing slurry, for detecting and/or identifying man-made underground tunnels. Such use involves placing the bentonite-slurry within a plurality of essentially-vertical moats along a desired bordering line. In certain embodiments, said detecting or identifying underground tunnels is done by digging and filling with bentonite or any bentonite-containing slurry at least one essentially-vertical moat, wherein the detection of drainage of the bentonite-slurry into the moat during the dig indicates the presence of an underground tunnel at the location of the dig.

The present invention also relates to the use of bentonite or any bentonite-containing slurry for preventing passage through man-made underground tunnels.

Another advantage of the bentonite-slurry filled moats used in the system and method of the invention, is that in addition to the detection of the newly dug underground tunnel, the fact that the bentonite-slurry is poured into the tunnel, it forces the diggers to stop digging until all the bentonite is removed.

Accordingly, the present invention further relates to the use of bentonite or any bentonite-containing slurry for the destruction of underground tunnels or passageways. Such destruction can be achieved by, e.g., pouring said bentonite or bentonite-containing slurry into such an underground tunnel or passageway, which was identified either by the system or method of the invention or by any other means. The bentonite or bentonite-slurry may be poured into said tunnel through any opening thereof—either at its beginning or its end, or at any location or opening along said tunnel.

EXAMPLES

Example 1

Testing Bentonite's Stability in a Moat

The bentonite-slurry is prepared by mixing 50-60 kg montmorillonite in 1000 kg of water. In order to determine the stability of the bentonite-slurry, decantation (i.e. water separation) of the slurry is examined, and should be negligible for at least 4 months. In addition, the slurry should maintain a water-like fluidity over time, meaning it should remain permanently weak and thixotropic to flow like a viscous liquid.

Two additional bentonite slurries are prepared in a similar manner, this time with the addition of 10 or 20% cement.

A digging machine digs a plurality of moats to a depth of about 40 to about 45 meters and simultaneously fills them with the bentonite-slurry. For each type of slurry 3 moats are made at a length of about 2.8 to about 3.4 meters and a width of about 0.4 meters. The distance between each moat is about 1 meter. Each moat has a concrete "guide" to a depth of about 1.5 meters. The top of said "guide" may be in line with the ground surface or extending from the ground surface.

The stability of the slurry in each moat is examined for a long period of time (more than a year), in terms of decantation and maintaining a water-like fluidity.

Results: When the bentonite concentration is about 4%, there is no visible decantation even after 1 year and the bentonite-slurry maintained its water-like fluidity.

Example 2

Digging a Tunnel into a Bentonite-filled Moat

Moats are dug and filled with bentonite-slurry prepared as described above. In front of each moat, a tunnel of about 0.5 meter diameter is dug at a depth of about 5 to about 10 meters and from a distance of about 50 meters from the moats.

At the top of each moat a sensor is placed designed to detect any change of the level of the bentonite-slurry in the moat.

The digging of the different tunnels is synchronized so that each tunnel reaches its designated moat at a predetermined time after the digging of the moat: 1 day after digging the moat; 1 week after digging; 1 month after digging; and 1 year after digging the moat.

Results: in all scenarios, as soon as the tunnel reached the moat, the bentonite-slurry spilled into the tunnel, causing a decrease in the level of slurry in the moat and subsequently activating the sensor.

Example 3

Comparison of Water Loss Between Sodium- and Calcium-bentonite Slurries

Intrinsic Permeability of the Filter Cake Kc (Darcy's Law)

The loss of water volume increases linearly with the square root of time as determined in Equation 1:

$$\Omega = \left[\frac{2\Delta PA^2K}{\mu b}\right]^{0,5} t^{0,5} = at^{0,5} \tag{1}$$

Therefore, the slope filtration curve and Kc can be assessed as given in Equations 2 & 3:

$$K_c = \frac{a^2\mu b}{2\Delta PA^2} \tag{2}$$

$$b = \frac{cA}{\Omega} \tag{3}$$

Thus, the permeability obtained by filter press test results can be set according to hydraulic conductivity as determined in Equation 4:

$$K = \frac{k\rho g}{\mu} \tag{4}$$

wherein: (Ω) is the volume of water loss ($m^3$); (P) is the difference of pressure (Pa); (A) is the section of filter cake ($m^2$); (μ) is the viscosity of Filtrate (kg/m/s) and is $10^{-1}$ kg/m/s; (b) is the specific volume of filter cake (m); (k) is the hydraulic conductivity ($m \cdot s^{-1}$); (K) is the intrinsic permeability ($m^2$); (d) is the density of liquid ($m^{-3}$), (g) is the gravity (9.81 $m \cdot s^{-2}$); and (t) is time (sec).

Tests conducted on natural sodium bentonite and on activated calcium bentonite gave similar results on hydraulic conductivity varying within the range of from $1.2.10^{-11}$ $m \cdot s^{-1}$ to $2.4.10^{-11}$ $m \cdot s^{-1}$ for GSB: LX1, LX2, LX3 and LX5 (see Table 1 below):

TABLE 1

| | LX1 | LX2 | LX3 | LX5 |
|---|---|---|---|---|
| $k_O$ ($m \cdot s^{-1}$) | $2.4 \cdot 10^{-11}$ | $1.2 \cdot 10^{-11}$ | $1.4 \cdot 10^{-11}$ | $1.8 \cdot 10^{-11}$ |
| $nV_v$ | 3.4 | 2.1 | 1 | 3.5 |
| $k_{FP}$ ($m \cdot s^{-1}$) | $2.3 \cdot 10^{-11}$ | $1.9 \cdot 10^{-11}$ | $2.3 \cdot 10^{-11}$ | $1.9 \cdot 10^{-11}$ |

Figure 4:
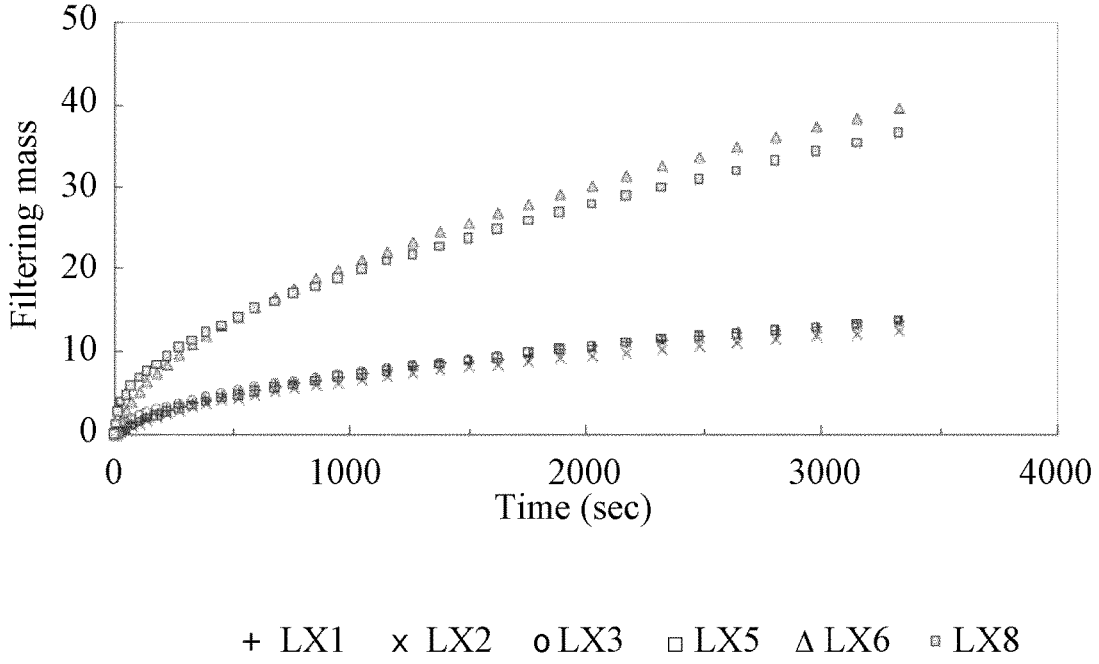
FIG. 4 shows a graph of the hydraulic conductivity results of various sodium- and calcium-bentonite slurries after salty water filtration.

As indicated in FIG. 4, hydraulic conductivity results of natural sodium bentonite were superior to those of calcium bentonite after filtration of salty water (NaCl).

Figure 5:
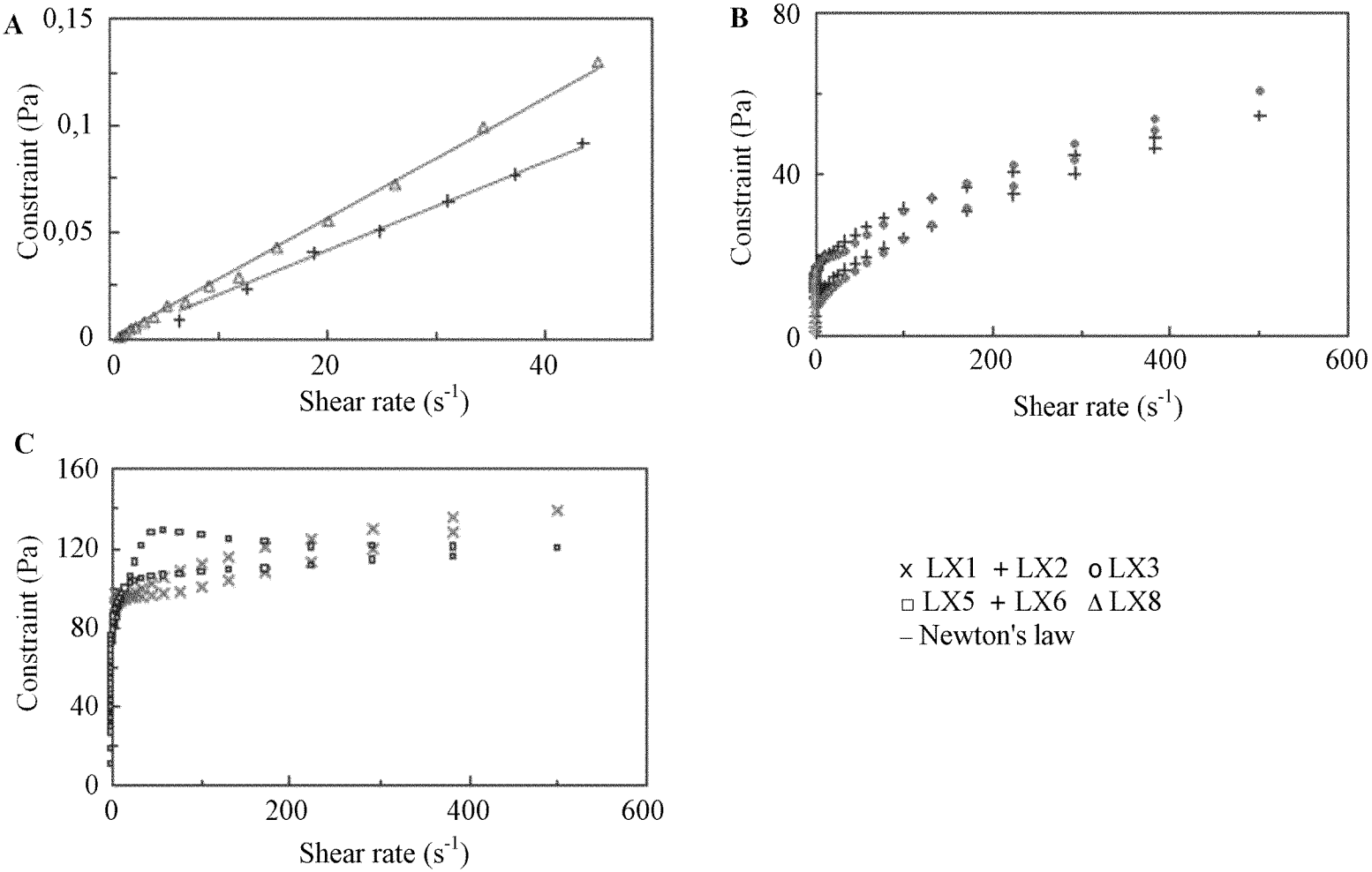
FIG. 5 shows graphs of the rheological properties of sodium- (B) and calcium-bentonite (C).

As indicated in FIG. 5, the rheological properties of natural sodium bentonite are also favorable over those of activated calcium bentonite.

Water Loss Assessment

The results in FIG. 5 allow for reasonable assessment of the amount of water loss during time.

The following parameters were used for calculation:

S=Panel surface ((3.40 m*0.60 m)*2)*30.00 m=240 $m^2$;

P=Bentonite slurry (80 kg)=10.50 $kN/m^3$*h=30.00 m=P maxi=315 kPa (P=integral 0 to 315 kPa), a broad assessment could be obtained by using conditions at midway=158 kPa.

As the filter cake thickness is governed by natural ground permeability which is varying from 8. $10E^{-3}$ m/s>k>$10E^{-7}$ m/s, only theoretical calculation is possible, based upon the hydraulic conductivity of the inner part of filter cake at the edge of the trench profile.

As the distance of penetration will be automatically adjusted according to plastic viscosity index and yield value, it can be assumed that a variable amount of bentonite-slurry is sealing alluvium from 0.1 m to several meters depth. Losses will be observed at the excavation and the process is normally mastered by increasing initial viscosity from 20 mPa·s to 50 mPa·s or more (yield is increasing from 25 Pa (50 lb/100 $f^2$) to 50 Pa).

However, according to lab test results the following filter cake hydraulic conductivity can be assumed:

$$K=2.5.10E^{-11} \text{ m/s}$$

Thus, a broad estimation of water loss due to filtration throughout a year can be evaluated as follows:

$$\Omega(m^3)=((s(240m^2)*P\text{mid}(158Pa)*k(2.5.10E^{-11}m/s)*t(31.104.000sec))^{0.5}\#5.10E^{-3}m^3$$

Example 4

Field Test

The Moat and Guide

Figure 6A:
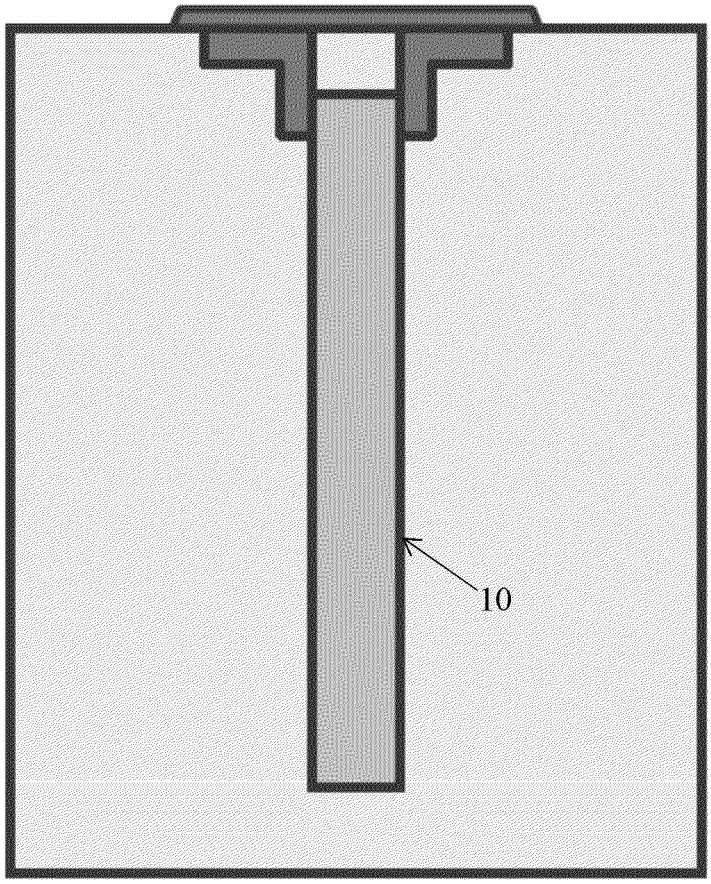
FIG. 6A is a side view showing the entire moat with a guide at its top.
Figure 6B:
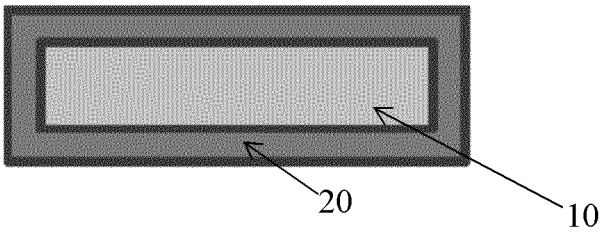
FIG. 6B is an upper view showing the moat's guide.

The bentonite-slurry moats are composed of staged panels set as shown in FIG. 6. The dimensions of each panel are: Length=3.40 m, width=0.60 m, and a depth of from 30.00 m to 60.00 m according to site location. The distance in between panel alignment does not exceed 1.50 m.

As shown in FIG. 6, the guide walls are 1.50 m deep to insure stability of the trench during excavation and to support the final cover for long term protection. The bentonite-slurry moats will be protected by a cover optionally with insulation materials.

Panel Excavation

The wall excavation was achieved with a (3.40 m*0.60 m) grab. Verticality of the moats was constantly monitored, to prevent any possible interference along excavation (risk of collapse).

The bentonite-slurry was prepared with 80 kg sodium bentonite (Acktiv-Bentonit BDF API—see Table 2 below) hydrated in fresh water, and treated with 1 $kg/m^3$ of fly Ash (sodium carbonate).

To prevent increasing sand content in the bentonite-slurry, slurry excavation was stopped after every 10.00 m, a mud pump was installed at the bottom of the moat, and desanding was carried out until the sand content in the slurry was lower than 2%. Then the excavation was resumed for another 10 m and so on down to full depth.

Once full depth was reached, a full substitution of the bentonite-slurry in the moat with a fresh bentonite-slurry was conducted. The substitution was done at the final stage of excavation when it was fully completed and no loss was observed.

After completion, the concrete covers were prepared and equipped with insulation material (e=0.150 m polyurethane material or similar). Before the moats were covered, a few liters of oil were poured into the moat (inside the guide walls) to prevent top water evaporation.

Summary of laboratory test results of Acktiv-Bentonite IBBCO BDF APIS&B are shown in FIGS. 7A-7B.

Specific Slurry Mix Design—Ultra Strong Filtration Resistance

According to the preliminary tests shown in Table 2 above, Acktiv-Bentonit BDF API can be used as is. However, the following procedures were conducted in order to improve its basic performance:

(a) Mix characteristics

Spg: 1.05; MFV: less than 120 sec/Qt; Sand: less than 1%; Decantation: 0%; Water loss: between 3 to 6 ml; pH: 8-10; Plastic viscosity: between 15 to 50 mPa·s; Yield value: between 15 to 30 Pa (b) Slurry mixing sequences and dosage for 1 $m^3$ slurry:

(i) Clear water+pH adjustment=Sodium Carbonate=1 kg; (ii) Bentonite API=80 kg; (iii) Dispersing agent type Flosperse 300=1 kg; and (iv) Water loss reducer type Flodrill TS655=6-9 kg

TABLE 2

| Montmorillonite % | Bentonite dosage % | Slurry density g/cm$^3$ | Mare viscosity s/l | FANN viscometer 600 RPM | FANN viscometer 300 RPM | Plasto viscosity mPa | Yield point lb/100 ft$^2$ | Gel strength 10 sec, Pa | Gel strength 10 min, Pa | Fluid loss, ml 7.6 min | Fluid loss, ml 30 min | Liquid limit N/m$^2$ |
|---|---|---|---|---|---|---|---|---|---|---|---|---|
| 75 | | | | | | After aging 24 hours | | | | | | |
| | 4 | 1.02 | 35 | 18 | 13 | 5 | 8 | 0.96 | 6.24 | 11.7 | 17.5 | 7.92 |
| | 5 | 1.03 | 43 | 30 | 24 | 6 | 18 | 1.92 | 12.96 | 10.5 | 16.8 | 16.02 |
| | 6.4 | 1.038 | 72 | 42 | 35 | 7 | 28 | 8.16 | 22.56 | 9 | 15.5 | 53.62 |

What is claimed is:

1. A system for detecting underground tunnels, comprising:

a) at least one bentonite-slurry filled essentially-vertical moat;

b) at least one detection device associated with each of said at least one moat; and c) at least one control system connected to all of said at least one detection devices, wherein when an underground tunnel is expanded to traverse any of said at least one moat, said bentonite-slurry drains into said underground tunnel and the detection device associated with said moat alerts that the bentonite-slurry has drained thus signaling the existence of an underground tunnel in the location of the moat.

2. The system of claim 1, wherein said essentially-vertical moats are dug along a bordering line either (i) at two essentially-parallel dashed lines with about 1 meter spacing between the lines, and wherein the openings (un-dug section) in the first line are placed in front of the moats of the second line, thereby creating a zipper-like line; or (ii) at a single line with a maximum of 1 meter interval between each moat.

3. The system of claim 1, wherein said at least one detection device measures any one of the following parameters of the bentonite-slurry fill: level/volume, viscosity, content, conductivity, height, movement, position or any combination thereof.

4. The system of claim 1, wherein said at least one control system sends out an alert in response to any change in the measured parameters of a detection device indicating the presence of a newly dug tunnel in the area of the detection device.

5. The system of claim 1, further comprising a guide at the top of said at least one moat, wherein said guides are optionally formed when paving a road-like structure along the bordering line.

6. The system of claim 1, further comprising a cover over the openings of said at least one moat, e.g. to prevent unintentional falls therein, and to enable safe crossover, wherein said covers optionally comprise an access point enabling easy viewing and/or testing the bentonite-slur inside the moat.

7. The system according to claim 1 for detecting underground tunnels, wherein:

d) a plurality of bentonite-slurry filled essentially-vertical moats are dug along a bordering line at two essentially-parallel dashed lines with about 1 meter spacing between the lines, wherein the openings (the un-dug sections) in the first line are placed in front of the moats of the second line, thereby creating a zipper-like line;

e) a detection device associated with each of said moats designed to measure the level and/or volume of the bentonite-slurry in the moat, which immediately drops when a newly dug underground tunnel reaches the bentonite-slurry filled moat; and f) at least one control system connected to all of said detection devices, and sends out an alert when the level and/or volume of the bentonite-slurry drops, thereby indicating the presence of a newly dug underground tunnel.

8. A method for detecting and/or preventing passage through underground passageways or tunnels, comprising:

a) digging and filling with bentonite-slurry at least one essentially-vertical moat along a bordering line wherein when an underground tunnel is expanded to traverse any of said at least one moat, said bentonite-slurry drains into said underground tunnel thus preventing passage through the tunnel;

b) placing at least one detection device at each of said moats, designed to detect any change in the level and/or volume and/or other properties of the bentonite-slurry; and c) connecting said at least one detection device to at least one control system designed to onitor and alert when detecting such changes, wherein the detection of any change in the bentonite-slurry in the moat indicates the presence of a newly dug underground passageway.

9. The method of claim 8, wherein said at least one essentially-vertical moat runs along essentially the entire bordering line of interest.

10. The method of claim 8, wherein said change in the bentonite-slurry means change of any one of the following parameters: level/volume, viscosity, content, conductivity, depth, height, movement, position, or any combination thereof.

11. The method of claim 8, wherein said essentially-vertical moats are dug either (i) at a single line with a maximum of 1 meter interval between each moat; or (ii) at two essentially-parallel dashed lines with about 1 meter spacing between the lines, and wherein the openings in the first line are placed in front of the moats of the second line, thereby creating a zipper-like line.

12. The method of claim 8, further comprising creating a guide at the top of the moat, and/or covering the openings of the moats, e.g. to prevent unintentional falls therein, and to enable safe crossover.

13. The method of claim 8 further comprising a step of filling the detected tunnel with bentonite-slurry for preventing passage through the tunnel.

14. A method for preventing passage through underground passageways or tunnels, comprising:

a) detecting an underground passageway or tunnel according to the method of claim 8; and b) filling said passageway or tunnel with bentonite-slurry for preventing passage through the detected tunnel.

15. A method for detecting underground passageways or tunnels, comprising:

a) digging and filling with bentonite-slurry a plurality of essentially-vertical moats along a bordering line at two essentially-parallel dashed lines with about 1 meter spacing between the lines, wherein the openings (the un-dug sections) in the first line are placed in front of the moats of the second line, thereby creating a zipper-like line;

b) placing a detection device at each of said moats, designed to detect any change in the level and/or volume of the bentonite-slurry, which immediately drops when a newly dug underground tunnel reaches the bentonite-slurry filled moat; and c) connecting all of said detection devices to a control system designed to monitor and alert when detecting such changes, wherein the detection of such changes in the bentonite-slurry in the moat indicates the presence of a newly dug underground tunnel.

16. A method for preventing passage through underground passageways or tunnels, comprising:

a) detecting an underground passageway or tunnel according to the method of claim 15; and b) filling said passageway or tunnel with bentonite-slurry for preventing passage through the detected tunnel.

* * * * *